US007509916B1

(12) United States Patent
Nelson, Jr.

(10) Patent No.: US 7,509,916 B1
(45) Date of Patent: Mar. 31, 2009

(54) FLOATING DOCK WITH INTEGRATED BOAT LIFT

(76) Inventor: Ben Nelson, Jr., 10923 Enterprise Ave., Bonita Springs, FL (US) 34135

( * ) Notice: Subject to any disclaimer, the term of this patent is extended or adjusted under 35 U.S.C. 154(b) by 0 days.

(21) Appl. No.: 12/069,914

(22) Filed: Feb. 13, 2008

Related U.S. Application Data

(60) Provisional application No. 60/901,139, filed on Feb. 13, 2007.

(51) Int. Cl.
*B63C 1/02* (2006.01)

(52) U.S. Cl. ..... 114/45

(58) Field of Classification Search ..... 114/45
See application file for complete search history.

(56) References Cited

U.S. PATENT DOCUMENTS

| | | | | | |
|---|---|---|---|---|---|
| 3,265,024 | A * | 8/1966 | Kramlich | ..... | 114/45 |
| 4,955,308 | A * | 9/1990 | Craddock | ..... | 114/45 |
| 6,006,687 | A * | 12/1999 | Hillman et al. | ..... | 114/46 |
| 6,543,375 | B1 * | 4/2003 | Sargent et al. | ..... | 114/45 |
| 6,904,857 | B1 * | 6/2005 | Holden | ..... | 114/51 |

* cited by examiner

*Primary Examiner*—Stephen Avila
(74) *Attorney, Agent, or Firm*—William E. Noonan

(57) ABSTRACT

A marine dock and integrated boat lift include a dock portion having a framework that carries a plurality of float elements. A lift is mounted within the framework between an upper walking surface of the dock and the underlying body of water.

19 Claims, 12 Drawing Sheets

FLOATING DOCK WITH INTEGRATED BOAT LIFT

RELATED APPLICATION

This application claims the benefit of U.S. Provisional Patent Application Ser. No. 60/901,139 filed Feb. 13, 2007.

FIELD OF THE INVENTION

This invention relates to a floating dock having an integral boat lift installed below the walking surface of the dock and above the surface of the water.

BACKGROUND OF THE INVENTION

Boating on lakes, ponds, bays and other inland or partially enclosed bodies of water has become increasingly popular. Docks, piers, boat lifts and similar structures must be built to keep pace with this increased boat traffic. However, environmental factors, governmental regulations and/or community restrictions often limit the types of boat accommodating structures that can be installed in a lake or similar body of water. Driving pilings into the lake bottom to support a dock or lift may be prohibited for aesthetic reasons or because such pilings may cause environmental damage to the bottom. In other cases, it simply may be too difficult or even impossible to install a piling into a lake bottom if the lake bottom is composed of relatively impenetrable rock.

Various types of floating docks and floating lifts have been developed. However, none of these products integrates a boat lift into the dock in an efficient, practical and commercially viable manner. Moreover, freely floating docks and lifts tend to be fairly top heavy and unstable. Often these structures do not function properly when they encounter rough wave action and/or high winds. Such conditions are common on inland lakes and ponds. When rough conditions are encountered, it would be very desirable to provide improved stability and support for floating docks and lifts.

SUMMARY OF THE INVENTION

It is therefore an object of the present invention to provide a floating dock assembly having a stable and reliably operating boat lift mounted integrally thereon.

It is a further object of this invention to provide a floating marine dock and boat lift that may be used effectively on lakes, ponds, sheltered bays and other inland bodies of water.

It is a further object of this invention to provide a floating dock and boat lift that may be used effectively on bodies of water where permanently anchored pilings are prohibited by governmental regulations, community restrictions, environmental limitations or otherwise.

It is a further object of this invention to provide a floating dock and boat lift that is particularly effective for use on bodies of water having floors or bottoms that do not permit the installation of permanently anchored pilings.

It is a further object of this invention to provide a floating dock and lift that utilizes a unique and extremely stable lift mounting construction, wherein the lift is supported below the walking surface of the dock but above the water line to effectively resist tipping or overturning even under rough water conditions.

It is a further object of this invention to provide a floating dock and lift assembly which can be used effectively on all types of lakes, ponds and bays and other inland or partially enclosed bodies of water without causing significant environmental disruption or damage to the floor or bottom of the body of water.

This invention results from a realization that an improved and extremely stable floating dock and integrated boat lift may be accomplished by mounting the lift integrally within the structure of the dock such that the lift is below the walking surface of the dock and above the underlying body of water. This provides for a center of gravity that is low enough so that the assembly effectively resists tipping even in rough conditions.

This invention features a floating dock and integral boat lift assembly. There is a dock portion including a pair of spaced apart and interconnected side dock segments. Each side dock segment includes a frame for supporting a respective walking surface. A plurality of float elements are attached to and depend from the frame of each side dock segment for floatably supporting respective side dock segments upon a body of water. A boat lift is supported by the dock portion and includes a first motor driven winder mechanism attached to the frame of one of the side dock segments. The first winder mechanism is disposed between the walking surface and the float elements attached to the frame of that dock segment. There is a second motorized winder mechanism mounted to the frame of the other side dock segment and disposed between the upper walking surface and the float elements attached to that dock segment. Lift cables wound operably upon the winder mechanisms support a lift platform. That platform is disposed beneath the walking surface of the side dock segments and extends between the dock segments. The motorized winder mechanisms are operated to selectively lift and lower the cables and the lift platform. A boat supported on the lift platform is thereby selectively raised and lowered by the lift.

In a preferred embodiment, each side dock segment includes an upper frame portion for supporting the walking surface of the dock segment thereon and a lower frame portion for supporting a respective winder mechanism thereon. The upper frame portion may include a plurality of longitudinal upper frame stringer components that are disposed generally parallel to one another, and a pair of transverse upper frame components that interconnect respective ends of the stringer components to one another. The lower frame portion may include a plurality of transverse lower frame components that extend across the stringer components and generally parallel to one another. All of the upper and lower frame components may comprise elongate aluminum extrusions or similar types of lightweight and marine resistant structural members.

The lift may include a pair of elongate cable beam assemblies that are supported on respective side dock segments and, which, in turn, rotatably support respective winder mechanisms. Each cable beam and associated winder mechanism is disposed between the lower frame portion of a respective dock segment and the walking surface of that dock segment.

The float elements may be attached to hang from the lower frame portion. Such float elements may be spaced apart somewhat so that the cables depending from the winder mechanisms are received between respective adjoining pairs of float elements. The lift platform may include a pair of spaced apart and substantially parallel cradle beams that extend between the side dock segment. Standard bunk components may interconnect the cradle beams. One of the cradle beams is typically attached to a first cable depending from a first one of the winders and a second cable depending from the other, second winder. Similarly, the second cradle beam is attached to a third cable extending from the first winder and a fourth cable extending from the second winder. The ends of the cable beams may extend into the gaps between the respective adjoining pairs of float elements. Accordingly, as the lift motors are operated, the lift platform is selectively raised and lowered relative to the dock.

The first and second side dock segments may be elongate and generally parallel to one another. The dock segments are typically interconnected by a transverse dock section having an upper frame portion for supporting a walkway and a lower frame portion for supporting one or more float elements. The upper frame portion of the transverse dock section carries a generally planar walking surface. A plurality of float elements are typically carried by the lower frame portion of the transverse dock section.

Standard boat lift related mechanisms may be utilized on or proximate to the assembly. For example, batteries may be mounted within the framework of the dock segments for powering the respective lift drive units. An optional solar panel may be mounted to either the spaced apart dock segments or the transverse dock segment interconnecting the parallel side segments.

DETAILED DESCRIPTION OF PREFERRED EMBODIMENTS

Other objects, features and advantages will occur from the following description of a preferred embodiment and the accompanying drawings, in which.

Figure 1:
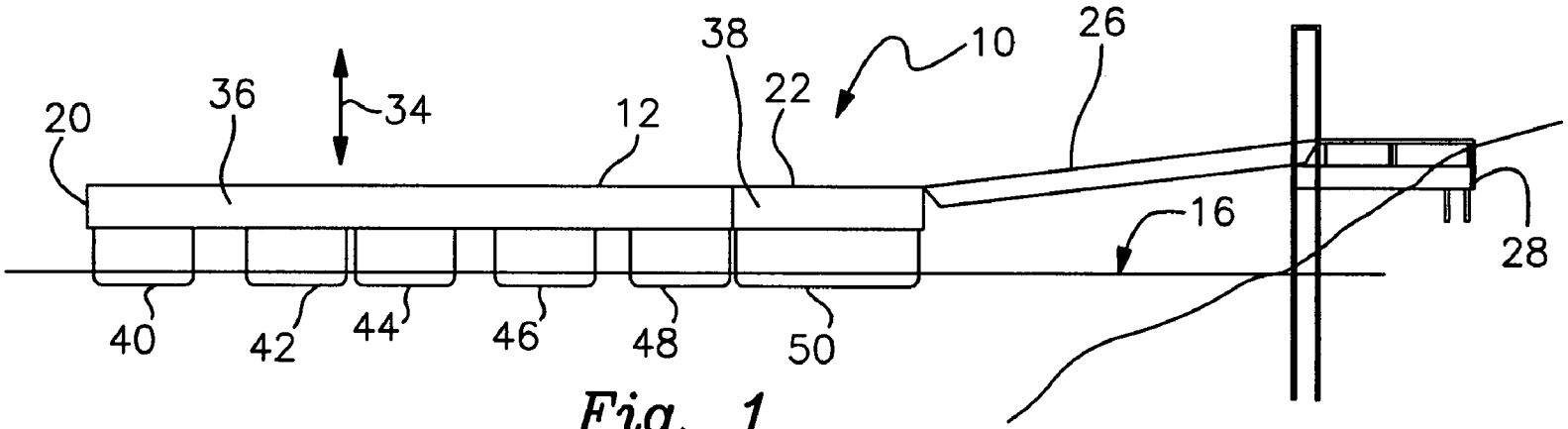
FIG. 1 is a side elevational view of one preferred version of the floating marine dock and integral boat lift in accordance with this invention.
Figure 2:
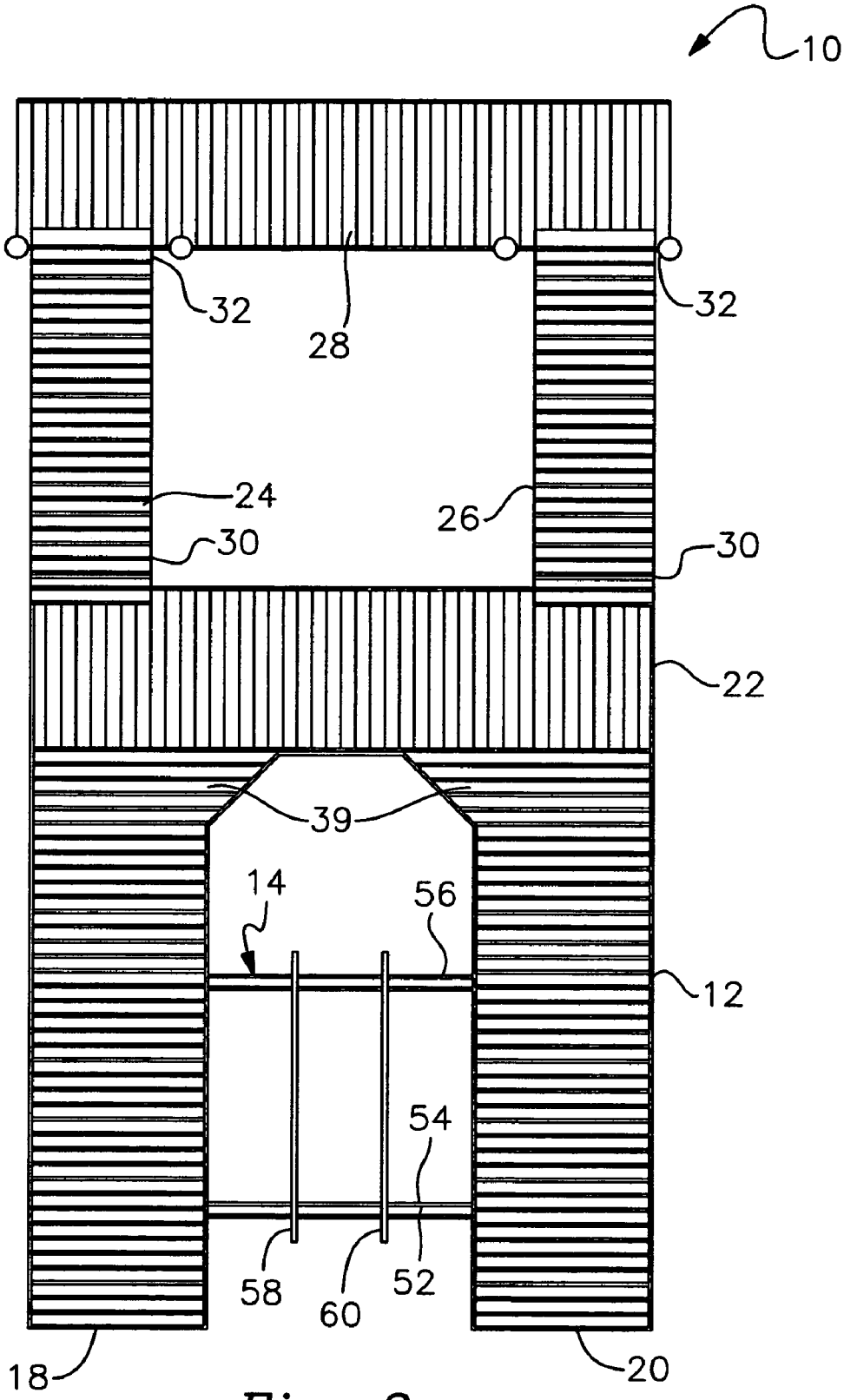
FIG. 2 is a top plan view of the dock and lift shown in FIG. 1.

There is shown in FIGS. 1 and 2 a floating dock and integral boat lift assembly 10 in accordance with this invention. Assembly 10 includes a generally U-shaped dock 12 and a winch or winder driven boat lift apparatus 14 that is mounted integrally to dock 12. It should be understood that various types of boat lifts with assorted drive mechanisms may by incorporated within the floating assembly in accordance with this invention.

Assembly 10 is designed to be installed in an inland or partially enclosed body of water 16 such as a lake, pond or relatively sheltered bay. However, the particular body of water in which the dock/lift assembly may be employed is not a limitation of the this invention and the assembly may be utilized in various sorts of marine environments. Nonetheless, the invention is particularly effective for use in waterways where restrictions exist against driving and/or otherwise installing pilings or piers into the floor or bottom of the body of water. These may comprise governmental or environmental restrictions, limitations imposed by neighboring waterfront communities and the like. Alternatively, pilings may be restricted because of practical concerns, i.e. the bottom or floor of the body of water may be too hard or rocky to penetrate or may be subject to environmental damage.

Dock 12 includes a pair of generally parallel side dock segments 18 and 20, which are interconnected by an intermediate dock section 22. The intermediate dock section is hingedly interconnected by a pair of ramps 24 and 26 to a conventional wood frame dock 28. Each of the ramps 24, 26 is interconnected to intermediate dock section 22 by a lower hinge 30 and is likewise connected to dock 28 by an upper hinge 32. This allows the floating dock/lift assembly 10 to float upwardly and downwardly as indicated by double-headed arrow 34 in response to rising or falling tides/water levels.

Each of the dock segments 18 and 20 includes a supportive frame 36, FIG. 1. Likewise, intermediate dock section 22 includes a supportive frame 38. This frame is described more fully below. Durable and marine resistant plastic planks 39, FIG. 2, are mounted above frames 36 and 38 and form an upper walking surface of the deck segments. Each frame 36 carries five float elements 40, 42, 44, 46 and 48 (FIG. 1). Likewise, frame 38 of intermediate dock section 22 carries a plurality of float elements 50, only one of which is shown in FIG. 1. These float elements, which are described in greater detail below, cause assembly 10 to float upon body of water 16.

Figure 3:
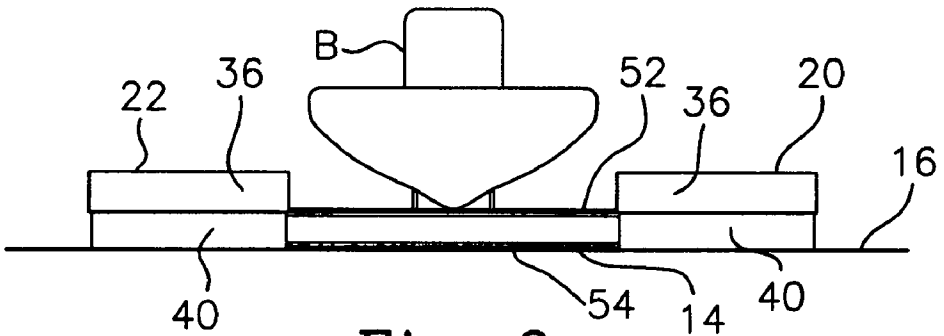
FIG. 3 is an elevational end view of the lift of FIGS. 1 and 2 with a boat supported on the lift platform.

Boat lift 14, which is depicted at least partially in FIGS. 2 and 3, includes a drive mechanism that is mounted within the frame 40 of each side dock segment 20 and 22. Once again, that portion of the lift apparatus is described below. A lift platform 52, comprising a pair of generally parallel cradle beams 54 and 56 and a transverse pair of interconnecting bunk boards 58 and 60, is supported by the lift's drive mechanism (obscured in FIGS. 1 and 2) between dock segments 20 and 22 and well below the upper walking surface of the docks. Platform 52 supports a boat B thereon so that when the lift is operated, the boat can be raised above or lowered into water 16 as required.

Figure 4:
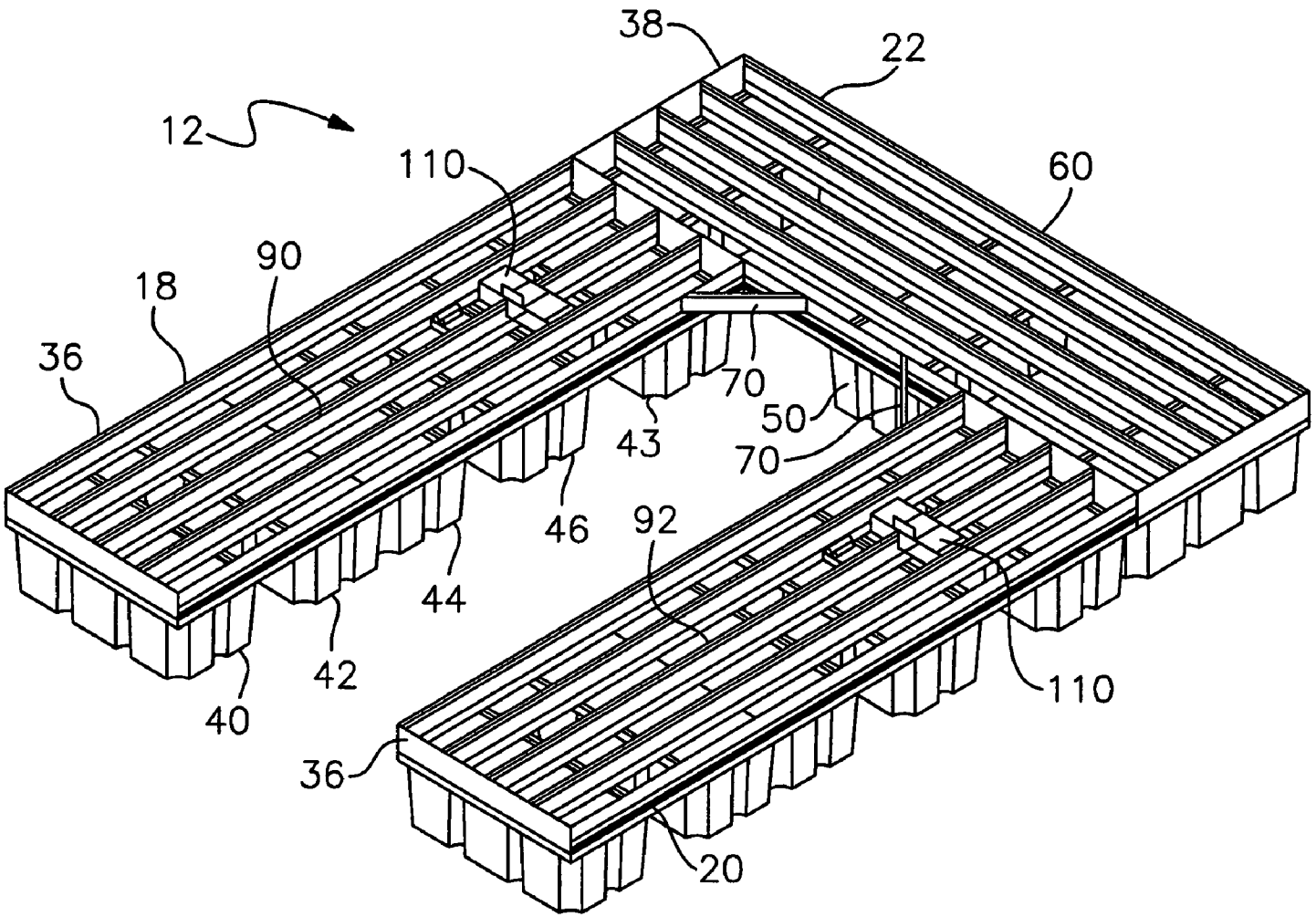
FIG. 4 is a perspective view of the preferred floating dock and lift with the walking surface removed to illustrate the lift components supported within the frame of the dock portion.
Figure 5:
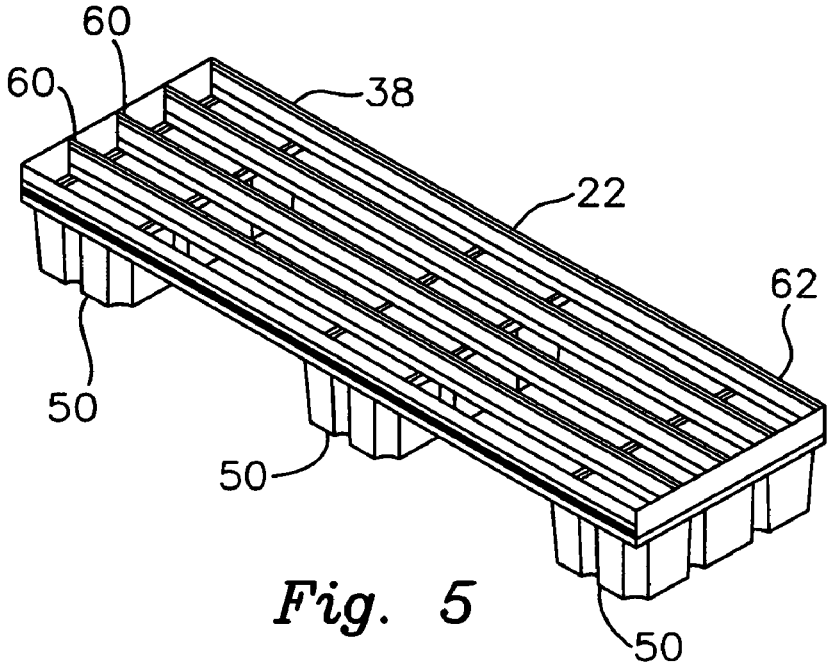
FIG. 5 is a perspective view of the intermediate dock segment.
Figure 9:
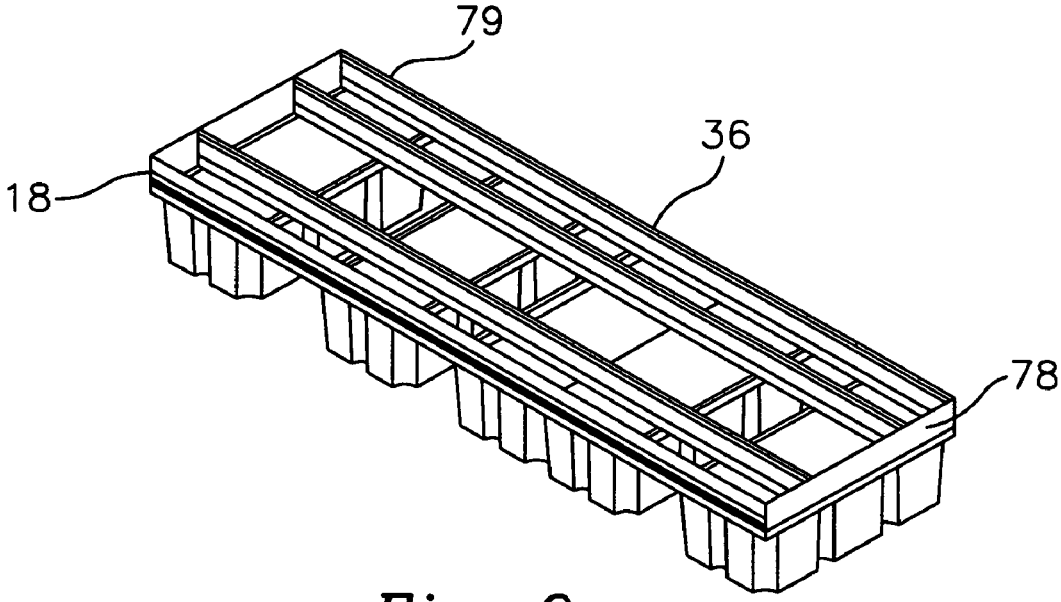
FIG. 9 is a perspective view of a representative one of the side dock segments.
Figure 6:
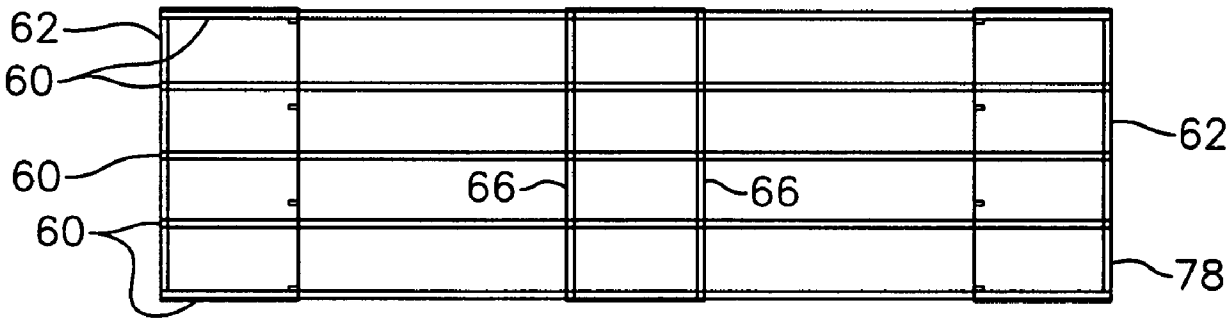
FIG. 6 is a top plan view of the intermediate dock segment.
Figure 7:
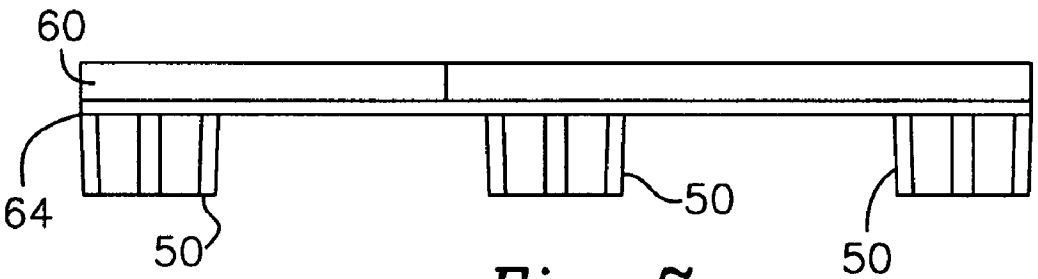
FIG. 7 is a front elevational view of the intermediate dock segment.
Figure 8:
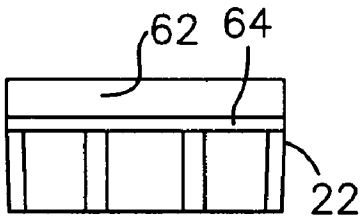
FIG. 8 is an elevational end view of the intermediate segment.

Dock 12 is depicted with the upper planks removed in FIG. 4. Frame 38 of intermediate dock section 22, which is shown by itself in FIGS. 5-8, includes five longitudinal upper frame stringers 60 typically comprising extruded aluminum components. These extend between transverse end pieces 62, which typically comprise flat bar. A lower frame section 64 includes pieces of aluminum channel that are secured to and extend below components 60 and 62 about the perimeter of the dock section 22. The lower frame section also includes flat bar transverse pieces 66, similar in construction to pieces 62, which are interconnected transversely below longitudinal stringers 60. The adjoining frame components are secured in dock section 22 (as well as in the side dock segments described below) by strong and durable stainless steel bolts or similar means of attachment, which are not specifically depicted.

Three float elements 50 are mounted to and depend from frame 38. In particular, a float element is attached at each end of the intermediate dock section and, more particularly, to lower frame section 64. A third intermediate float element is interconnected centrally beneath the dock section between transverse frame elements 66. The float elements may comprise, for example, Permafloat™ floatation billets having a buoyancy or supportive capacity that may be varied as needed that the user expects to apply to the assembly 10. The float elements are attached to the frame by strong, marine resistant bolts, not shown.

Side dock segments 18 and 20 are attached and extend from intermediate dock section 22 in the manner shown in FIG. 4. In particular, each of the dock segments 18 and 20 extends perpendicularly from intermediate dock section 22. Diagonal decking support braces 70 are interconnected respectively between the side dock segments and the intermediate deck section for reinforcing the interconnection between the respective sections of dock.

A representative dock segment 18 is depicted in FIGS. 9-12. It should be understood that dock segment 20 exhibits an identical or virtually identical construction. Generally, the construction of supportive frame 36 is analogous to that previously described for frame 38 of dock section 22. In particular, the framework of each side dock segment includes elongate pieces of aluminum extrusion, flat bar and channels that are assembled and interconnected using techniques and means of attachment understood to persons skilled in the art.

Figure 10:
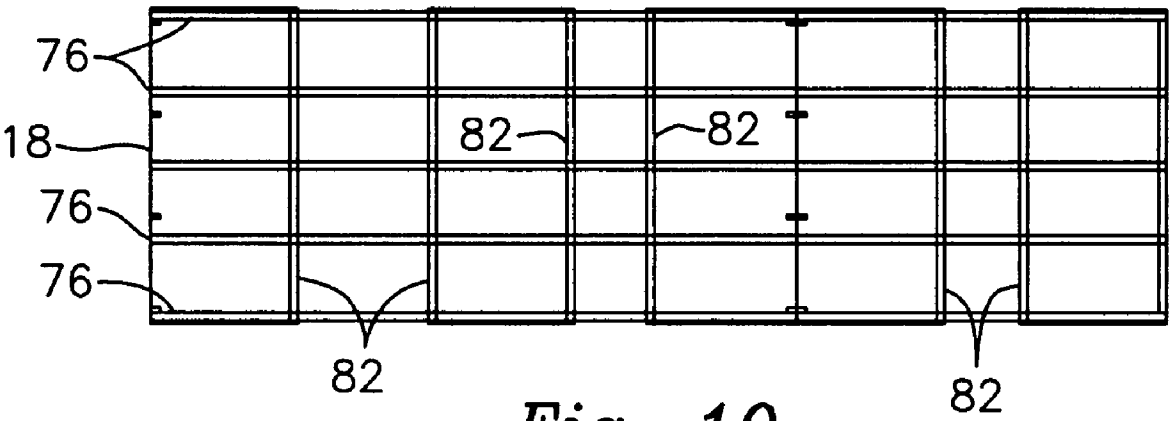
FIG. 10 is a top plan view of the side dock segment.
Figure 11:
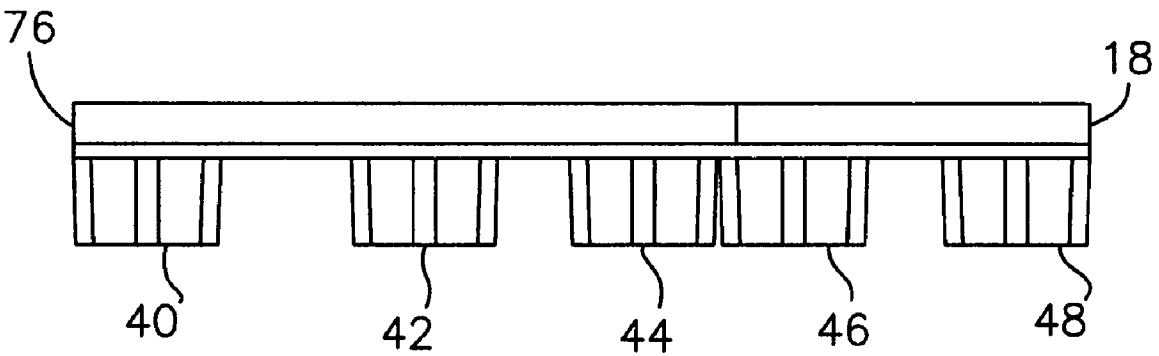
FIG. 11 is an elevational front view of the side dock segment.
Figure 12:
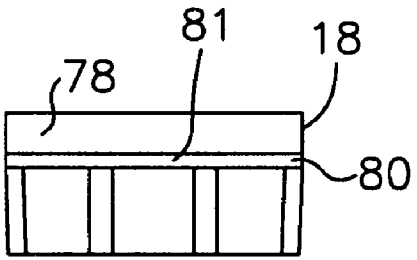
FIG. 12 is an elevational end view of the side dock segment.

Each frame 36 includes an upper section featuring a series of four longitudinal stringers 76. Unlike the frame of the intermediate deck section, the central stringer is omitted so that a portion of the lift may be accommodated within the frame as is described more fully below. These stringers are typically extruded and interconnected between flat bar end caps 78 that extend transversely to the stringers at respective ends of frame 36. Once again, the stringers and the end caps form an upper frame section 79. A lower frame section is defined by a channel element 80 that extends peripherally about the frame section and is bolted or otherwise secured to the upper frame section. Lower frame section 80 further includes transverse channels 82 that extend beneath stringers 76 and between peripheral channel 80 as shown in FIG. 10.

Each of the side dock segment frames 36 carries five Permafloat™ floatation billets or equivalent types of float elements 40, 42, 44, 46 and 48. These floatation elements are bolted to lower frame 80 by appropriate fasteners. Each float element is provided with a desired amount of buoyancy. For example, in a preferred version, each of the ten float elements employed by the two side dock segments 18 and 20, may exhibit a buoyancy of approximately 1716 lbs. This allows the side dock segments to support a total weight of 17,160 lbs. As a result, dock 12 is able to easily support a boat of 4500 lbs. and a lift and associated drive structure of 2840 lbs. The size of the float elements may be varied to accommodate various expected boat and boat lift weights.

Typically, the dock segments are completed by attaching planks 39 to the upper frame sections of the respective dock segments. This step is not performed until the lift components are installed within the dock framework as is described more fully below. Eventually, the dock is fully assembled by attaching side segments 18 and 20 to intermediate section 22. Such attachment is accomplished using bolts or other appropriate types of fasteners suitable for a marine environment. Indeed, all of the various extrusions, channels and other components used in the dock framework may be interconnected using fasteners of the type that will be known to persons skilled in the art. Known manufacturing techniques may also be utilized to assemble these parts.

Figure 13:
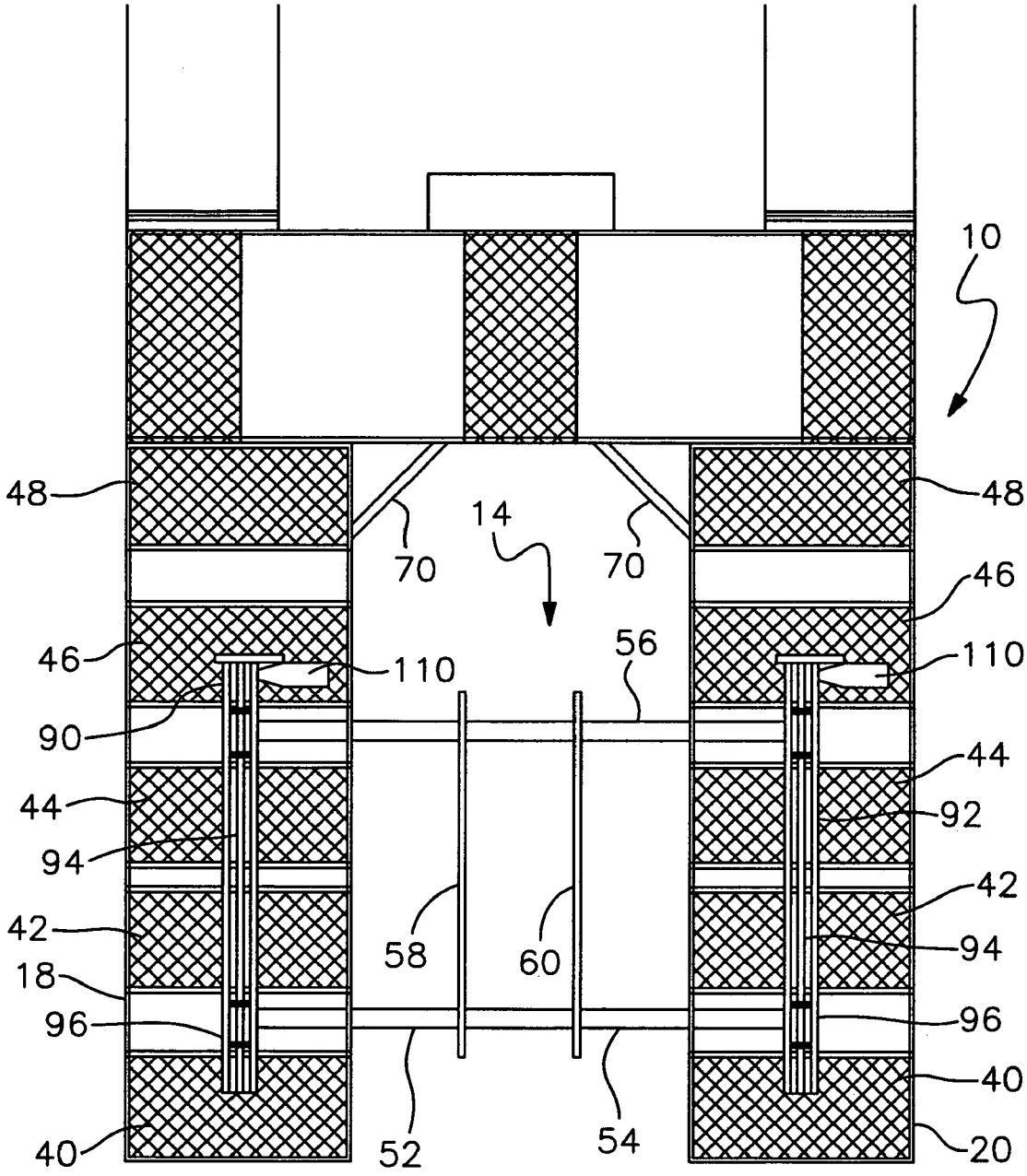
FIG. 13 is a top plan view of the floating deck/lift assembly with some of the framework omitted for clarity.
Figure 16:
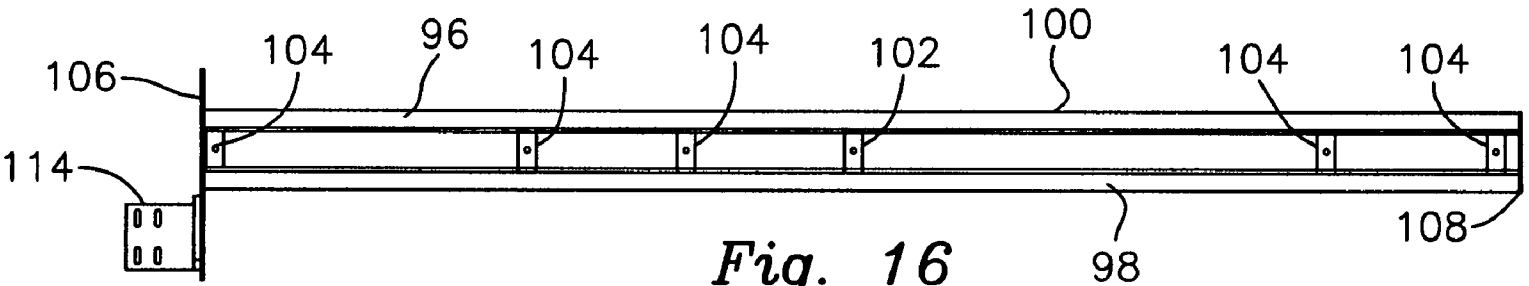
FIG. 16 is a top plan view of a preferred lift or cable beam as used in the assembly of this invention.
Figure 17:
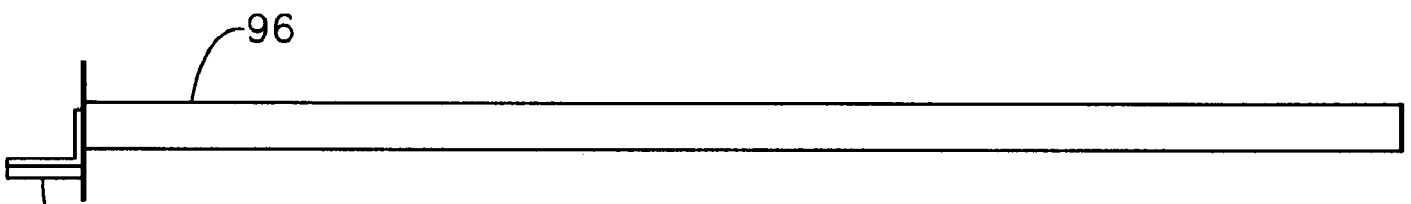
FIG. 17 is a side elevational view of the cable beam.

In FIG. 13, an overhead view of the dock and integral lift assembly 10 is depicted with the walking surface and upper frame sections of the dock sections omitted to more clearly illustrate the lift 14. The lift includes a first lifting mechanism 90 arranged longitudinally on dock segment 18 and a second lifting mechanism 92 similarly arranged on dock segment 20. As further depicted in FIGS. 14 and 15, each of the lift mechanisms 90, 92 includes an elongate winder 94 that is axially rotatably mounted in an elongate cable beam 96. Cable beam 96, which is shown alone in FIGS. 16 and 17, comprises a pair of elongate channel elements 98 and 100 that are interconnected by a spacer plate 102 and five bearing blocks 104. A back plate 106 is formed at one end of the cable beam and an end plate 108 is formed at the opposite end. Each cable beam 90, 92 is mounted above and extends longitudinally across the lower frame portion 80 of a respective dock segment frame and beneath the upper walking surface 39. As best depicted in FIG. 15, the channels 98 and 100 of cable beam 96 are disposed beneath the elongate stringers 76 of upper frame portion 78. Lift mechanisms 90 and 92 are also shown recessed within the respective side dock segment frames in FIG. 4.

Figure 18:
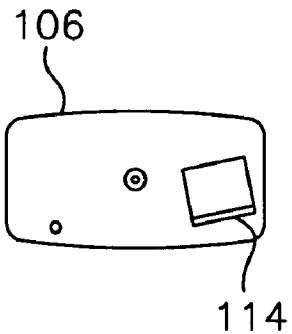
FIG. 18 is a front elevational view of the head plate to which the cable beam of FIGS. 16 and 17 is mounted.

Each of the lift mechanisms 90 and 92 is provided with a standard drive unit 110, which may be operatively connected to the winder as shown in either FIG. 4 or FIGS. 13-15. For example, in the version of the lift mechanism shown in FIGS. 16-18, a gearbox may be fastened to bracket 114. That gearbox is operatively connected to winder 94, FIGS. 14 and 15 in a conventional manner. Various known types of motors, gears and/or other forms of reduction mechanisms for operating the winder may be utilized. It should be understood that the particular form of drive mechanism is not a limitation of this invention and particular variations to the drive unit will be known to persons skilled in the art. In all cases, the drive unit should be recessed within the frame of the respective dock segment such that it is disposed below the upper walking surface 39. The various components of the drive unit may be secured within the framework of the dock portion by bolts, brackets and other appropriate means of attachment. In all cases, however, it is important for various reasons that the drive unit be mounted within the frame and below the working surface of the dock portion. It should be understood that an analogous structure is utilized for both of the lift mechanisms 90 and 92.

Each lift mechanism 90, 92 further includes a pair of spaced apart lift cables 116 operatively wound upon the winder of that lift mechanism. One of these two cables is depicted in each of FIGS. 14 and 15. One pair of cables 116 is operatively wound about winder 94 of lift mechanism 90; the other pair of cables are similarly wound about the winder of lift mechanism 92. Cables 116 operatively hang from their respective winders in the manner shown in FIGS. 14 and 15. The lower ends of the cables are secured to cradle beams 54 and 56 of lift platform 52. In particular, one cable 116 of lift mechanism 90 is fastened proximate one end of beam 56. A corresponding cable 116 of lift mechanism 92 is likewise attached to the other end of beam 56. By the same token, a second cable 116 of lift mechanism 90 is secured proximate one end of cradle beam 54 and the second cable 116 of lift mechanism 92 is likewise fastened proximate the opposite end of beam 54. The cables are attached to the transverse cradle beams in a conventional manner. Each cable 116 depends downwardly from a respective winder through the lower frame 80 section of the dock and between an adjoining, spaced apart pair of float elements. In particular, one of the cables of each lift mechanism drops between spaced apart float elements 40 and 42, the other cable drops between float elements 44 and 46. Float elements 42 and 44 closely adjoin one another and do not include a gap as is formed between the remaining pairs of float elements.

Figure 14:
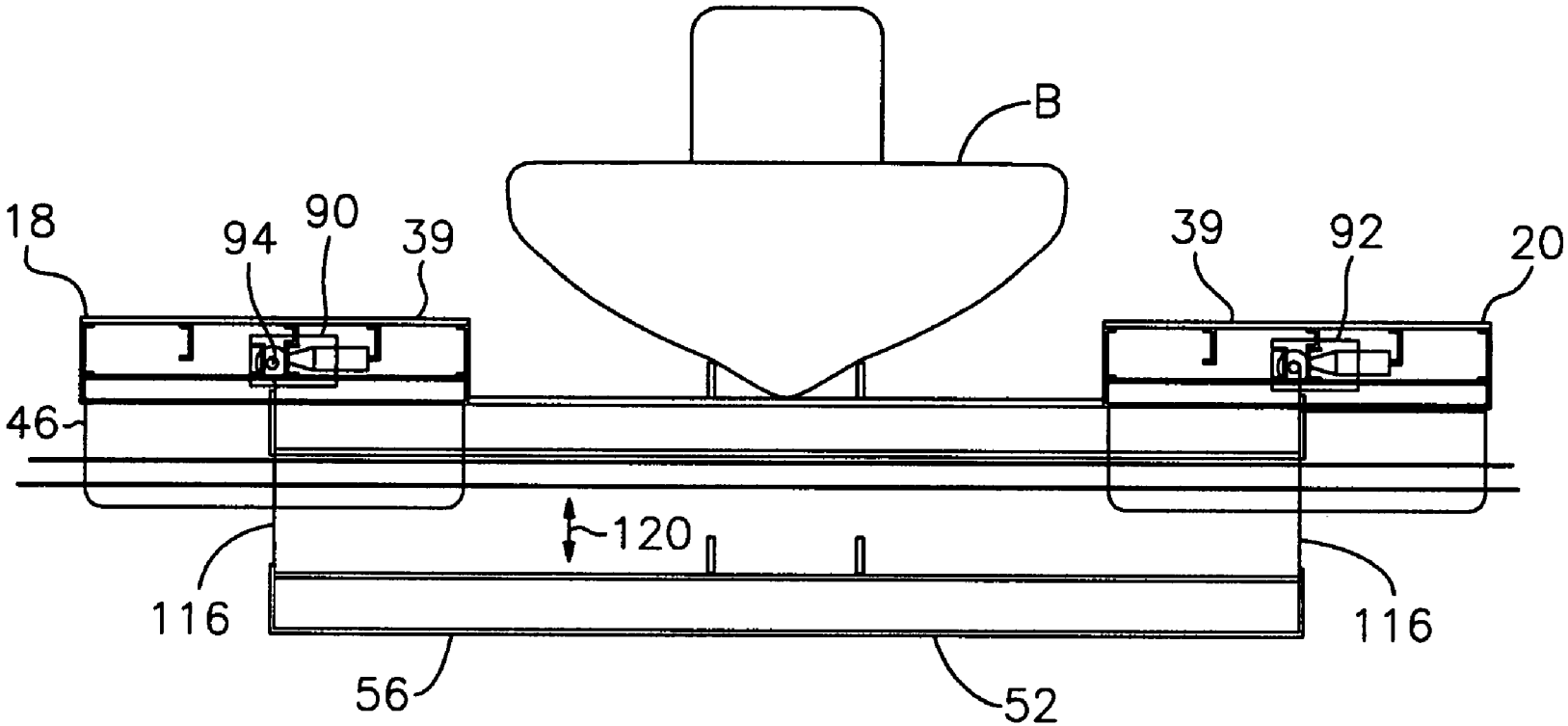
FIG. 14 is an elevational, cross sectional view of the assembly which depicts a boat supported on the lift platform and further depicting the platform alternately in raised and lowered conditions.
Figure 15:
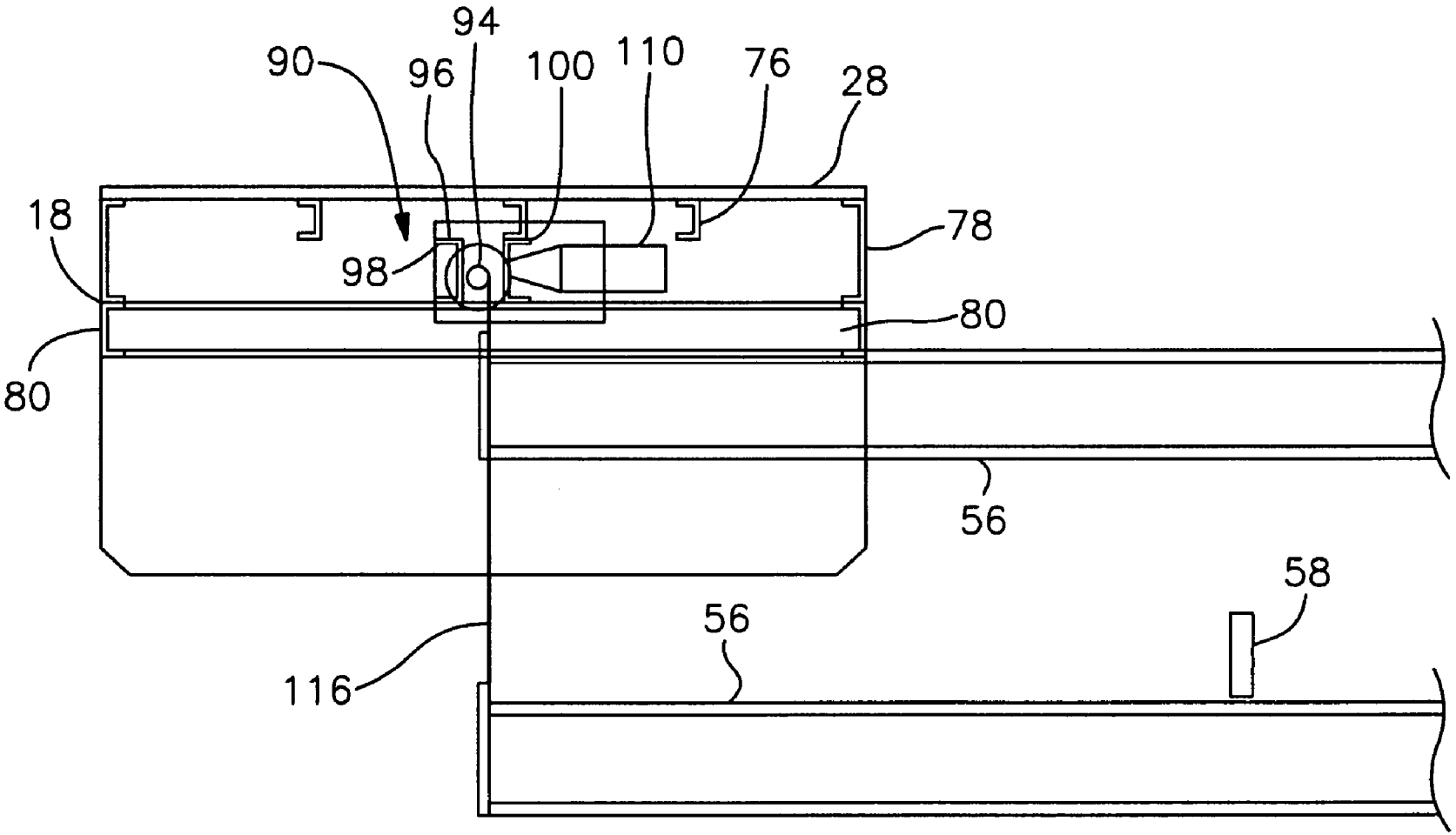
FIG. 15 is an elevational, cross sectional view of one of the side dock segments and its associated lift mechanism; the cradle is depicted alternately in raised and lowered positions.

The drive unit 110, FIGS. 14 and 15, is operated as needed to selectively raise and lower the transverse cradle beams 54, 56 of lift platform 52. Appropriate standard controls may be mounted on or proximate to floating dock/lift assembly 10 for selectively raising and lowering the lift platform 52 as shown indicated by doubleheaded arrow 120 in FIGS. 14 and 15. Each drive unit 110, may be equipped with a respective DC battery (not shown) which may be mounted below the upper surface of the dock in proximity with the respective lift mechanisms 90, 92. By the same token, one or more solar panels and recharging units, as described in U.S. Pat. No. 6,543,375, may be utilized to recharge the batteries. This eliminates the need to use alternating current for the lift and greatly improves the versatility of assembly 110. The description contained in U.S. Pat. No. 6,543,375 is incorporated herein by reference and the teachings provided in that reference may be utilized to operate the lift described herein.

In operation, the drive unit 110 of lift 14 is operated in a first direction to lower the platform into the water so that a boat B can be positioned onto or deployed from the lift. Operating the drive unit in an opposite direction raises the lift so that the supported vessel is raised out of the water. At no time, however, is the boat raised above the walking surface 39 of dock 12.

Assembly 10 integrates a lift 14 with a floating dock 12 in a manner that provides a number of benefits. The assembly may be utilized without requiring impractical and/or prohibited drilling into the floor or bottom of a body of water. The need to sink potentially environmentally damaging pilings is reduced, if not eliminated. The assembly is therefore convenient to use in lakes, ponds, closed bays and other inland bodies of water wherein pilings are prohibited by either governmental regulations and/or community restrictions. The lift operates conveniently and reliably.

As shown best in FIG. 14, the lift mechanisms 90 and 92 are operated in selected directions to raise and lower the lift cradles. In the raised condition, a boat B is supported above the body of water so that the hull of the boat may be cleaned and the vessel is raised out of the water for storage or servicing. By the same token, the lift platform is quickly and conveniently lowered so that the boat may be launched or retrieved as needed. It is quite important that the entire lift mechanism is located entirely below the upper walking surface 39 of dock portions 18 and 20. This greatly improves the center of gravity of the assembly and prevents unintended tipping or disruption of the assembly, even under conditions of rough waters, waves and/or high winds. The dock/lift assembly is much more stable than conventional floating docks.

Figure 19:
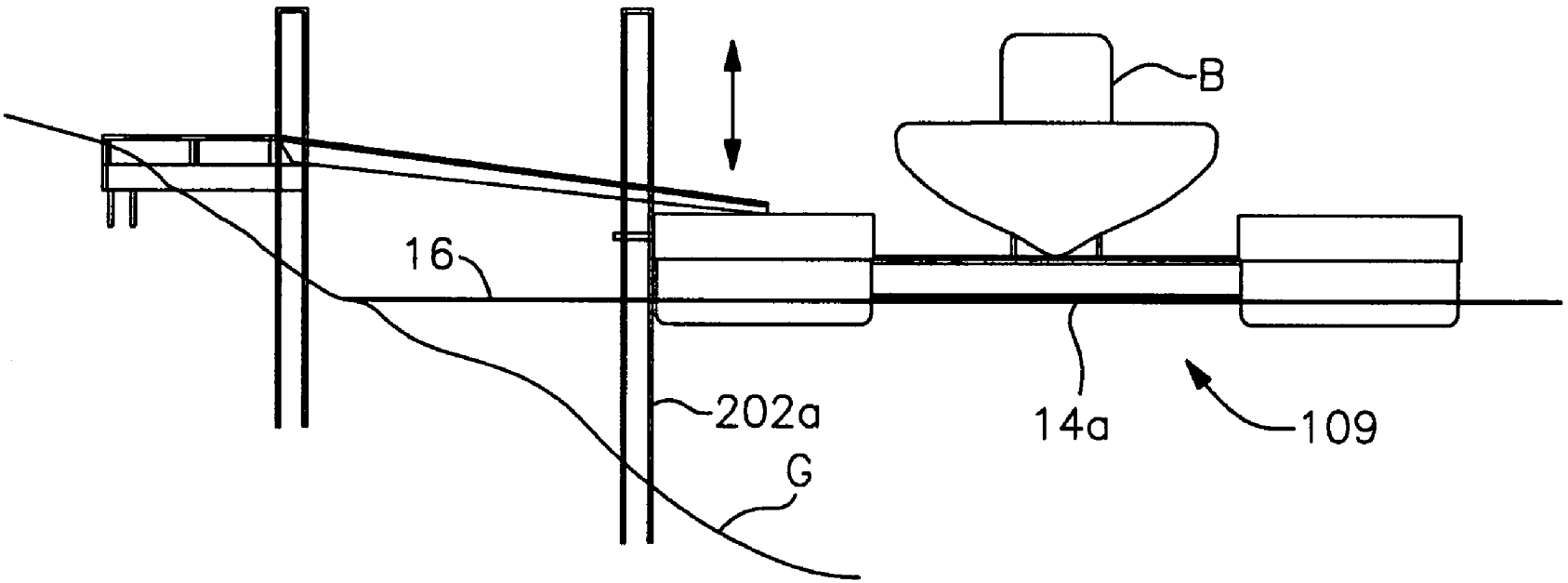
FIG. 19 is a front elevational view of an alternative floating dock and lift wherein a modified access ramp is employed and further wherein the dock is tied to pilings by means of pile hoops that constrain movement of the assembly.
Figure 20:
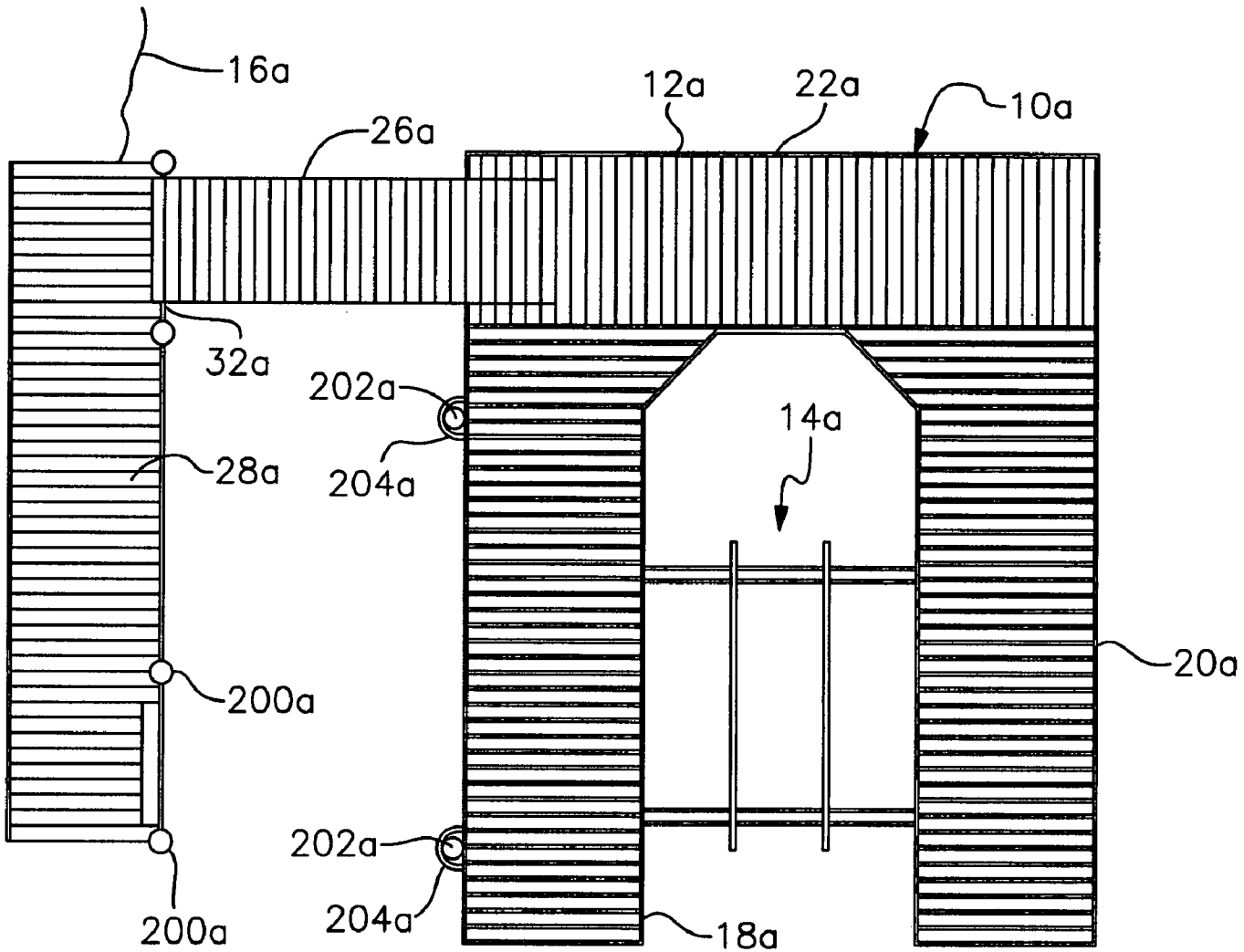
FIG. 20 is a top plan view of the assembly of FIG. 19.

A slightly modified version of the floating dock/lift assembly 10*a* is depicted in FIGS. 19 and 20. Therein, the assembly again employs a generally U-shaped dock structure 12*a* having elongate side dock segments 18*a* and 20*a* that are interconnected by an intermediate dock portion 22*a*. A boat lift 14*a* is integrated with the floating dock. A structure identical or similar to that previously described is utilized for both the dock and the lift.

In the version shown in FIGS. 19 and 20, a hinged ramp 26*a* is interconnected between a standard fixed wood frame dock 28*a* and intermediate dock portion 22*a*. In this version, pilings 200*a* are connected to dock 28*a*. The fixed dock 28*a* extends generally along or parallel to the edge of water 16*a*. Once again, a hinge 32*a* interconnects wood dock 28*a* and ramp 26*a*. The lower end of ramp of 26*a* interengages intermediate dock portion 22*a* by means of rollers, not shown. In this version, a second set of outer pilings 202*a* are installed in the underlying ground G as best shown in FIG. 19 proximate the edge of water 16. Assembly 10*a* is secured to pilings 202 by means of pile hoops 204*a* that are attached to dock portion 18*a* and which slip over the respective pilings 202*a*. Hoops 204*a* allow assembly 10*a* to move up and down with the rising and lowering level of water 16 while at the same time remaining engaged with pilings 202*a*. As a result, the floating dock/lift assembly does not float freely on water 16 but is kept somewhat close to shore and the fixed dock 200*a*. Convenient access is thereby provided to boat B, which is mounted on lift 14*a*. It should be understood that in all other regards, the version shown in FIGS. 19 and 20 is identical or analogous to that previously described.

In each of the versions of this invention, a compact, aesthetically attractive and extremely stable floating, dock mechanism is provided. The assembly may be utilized in all types of bodies of water without creating an adverse environmental impact. The structure complies with governmental prohibitions and community restrictions against driving pilings into the bottom of a body of water. An environmentally advantageous and extremely versatile floating dock/lift assembly is thereby provided.

Stability is improved by mounting the lift fully below the walking surface of the dock and thereby providing for a lower and more stable center of gravity.

From the foregoing it may be seen that the apparatus of this invention provides for an integral boat lift installed below the walking surface of the dock and above the surface of the water. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A floating dock and integral boat lift assembly comprising:

a dock portion including a pair of spaced apart and interconnected side dock segments, each side dock segment including a frame for supporting a respective walking surface;

a plurality of float elements attached to and depending from each said frame for floatably supporting respective said dock segments upon a body of water; and a boat lift supported by said dock portion and including a first motor driven winder mechanism attached to the frame of a first one of said side dock segments, said first winder mechanism disposed between said walking surface and said float elements attached to the frame of said first dock segment, said boat lift including a second motorized winder mechanism mounted to the frame of the other, second side dock segment and disposed between the upper walking surface and the float elements attached to said second side dock segment, said boat lift further including lift cables wound operably upon said first and second winder mechanisms for supporting a lift platform, said lift platform being disposed beneath said walking surfaces of said side dock segments and extending between said side dock segments, said motorized winder mechanisms being operated to selectively lift and lower said cables and said lift platform whereby a boat supported on said lift platform is selectively raised and lowered by said lift; said lift platform including a pair of spaced apart, generally parallel cradle beams that extend between said side dock segments, one of said cradle beams being attached to a first cable depending from said first winder mechanism and a second cable depending from second winder mechanism, the other said cradle beam being attached to a third cable extending from said first winder mechanism and a fourth cable extending from said second winder mechanism.

2. The assembly of claim 1 in which each said side dock segment includes an upper frame portion for supporting said walking surface of said side dock segment thereon and a lower frame portion for supporting a respective said winder mechanism thereon.

3. The assembly of claim 2 in which said upper frame portion includes a plurality of longitudinal upper frame stringer components disposed generally parallel to one another and a pair of transverse upper frame components that interconnect respective ends of said stringer components to one another.

4. The assembly of claim 3 in which said lower frame portion includes a plurality of transverse lower frame components that extend across said stringer components and generally parallel to one another.

5. The assembly of claim 1 in which said lift includes a pair of elongate cable beam assemblies that are supported on respective side dock segments for rotatably supporting respective winder mechanisms.

6. The assembly of claim 5 in which each side dock segment includes an upper frame portion for supporting said walking surface of said side dock segment thereon and a lower frame portion for supporting a respective winder mechanism thereon.

7. The assembly of claim 6 in which each said cable beam and respective winder mechanism is disposed between the lower frame portion of a respective side dock segment and the walking surface of that side dock segment.

8. The assembly of claim 2 in which said float elements are attached to hang from said lower frame portions.

9. The assembly of claim 8 in which said float elements are spaced apart such that said cables are received between respective adjoining pairs of said float elements.

10. The assembly of claim 1 further including bunk components that interconnect said cradle beams.

11. The assembly of claim 1 in which the ends of said cable beams extend into respective gaps between adjoining pairs of said float elements.

12. The assembly of claim 1 in which said first and second side dock segments are elongate and generally parallel to one another.

13. The assembly of claim 1 in which said side dock segments are interconnected by a transverse dock section having an upper frame portion for supporting a walkway and a lower frame portion for supporting one or more float elements.

14. The assembly of claim 13 in which said upper frame portion of said transverse dock section carries a generally planar walking surface.

15. The assembly of claim 13 in which a plurality of float elements are carried by said lower frame portion of said transverse dock section.

16. The assembly of claim 1 further including one or more batteries mounted within each frame of said side dock segments for powering said motorized winder mechanism.

17. The assembly of claim 13 further including a solar panel mounted to one of said dock segments and said transverse deck section.

18. The assembly of claim 1 in which said cradle beams are substantially parallel to one another.

19. A floating dock and integral boat lift assembly comprising:

a dock portion including a pair of spaced apart and interconnected side dock segments, each side dock segment including a frame for supporting a respective walking surface;

a plurality of float elements attached to and depending from each said frame for floatably supporting respective said dock segments upon a body of water; and a boat lift supported by said dock portion and including a first winder mechanism attached to the frame of a first one of said side dock segments, said first winder mechanism disposed between said walking surface and said float elements attached to the frame of said first dock segment, said boat lift including a second winder mechanism mounted to the frame of the other, second side dock segment and disposed between the upper walking surface and the float elements attached to said second side dock segment, said boat lift further including lift cables wound operably upon said first and second winder mechanisms for supporting a lift platform, said lift platform being disposed beneath said walking surfaces of said side dock segments and extending between said side dock segments, said winder mechanisms being operated to selectively lift and lower said cables and said lift platform whereby a boat supported on said lift platform is selectively raised and lowered by said lift; said lift platform including a pair of spaced apart, generally parallel cradle beams that extend between said side dock segments, one of said cradle beams being attached to a first cable depending from said first winder mechanism and a second cable depending from second winder mechanism, the other said cradle beam being attached to a third cable extending from said first winder mechanism and a fourth cable extending from said second winder mechanism.

* * * * *